US005505402A

United States Patent [19]

Vigneau

[11] Patent Number: 5,505,402

[45] Date of Patent: Apr. 9, 1996

[54] CORELESS SURFACE WINDER AND METHOD

[75] Inventor: Richard J. Vigneau, Green Bay, Wis.

[73] Assignee: Paper Converting Machine Company, Green Bay, Wis.

[21] Appl. No.: 280,435

[22] Filed: Jul. 28, 1994

Related U.S. Application Data

[63] Continuation-in-part of Ser. No. 108,105, Aug. 16, 1993, Pat. No. 5,402,960, and a continuation-in-part of Ser. No. 19,074, Feb. 18, 1993, Pat. No. 5,370,335.

[51] Int. Cl.[6] ..... B65H 35/08; B65H 18/14; B65H 18/26

[52] U.S. Cl. ..... 242/527.1; 242/541.2; 242/542.1; 242/542.2; 242/542.4; 242/547; 242/DIG. 3

[58] Field of Search ..... 242/527.1, 541.2, 242/542.1, 542.2, 542.4, 547, DIG. 3, 535.1

[56] References Cited

U.S. PATENT DOCUMENTS 3,065,505 11/1962 Pratt et al. ..... 242/DIG. 3 X

*Primary Examiner*—John Q. Nguyen
*Attorney, Agent, or Firm*—Tilton, Fallon, Lungmus & Chestnut

[57] ABSTRACT

A coreless surface winder and method wherein two of the winding drums are slightly spaced apart by a distance less than two web thicknesses which then operate to cause a folded leading edge on a transversely severed web to roll upon itself and develop an incipient log which thereafter is completed in a conventional three drum cradle to provide a coreless retail sized roll.

35 Claims, 12 Drawing Sheets

FIG. 5
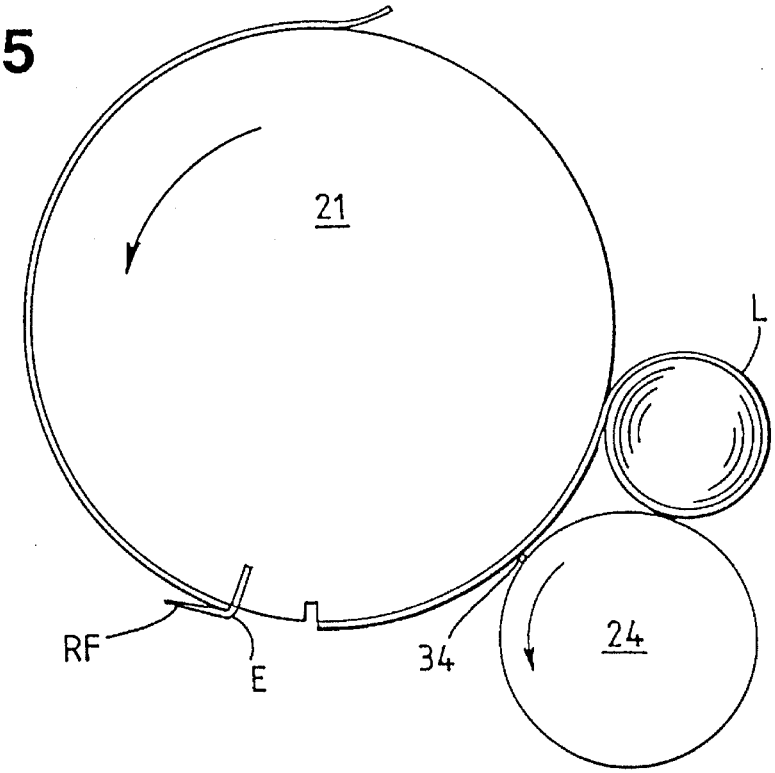
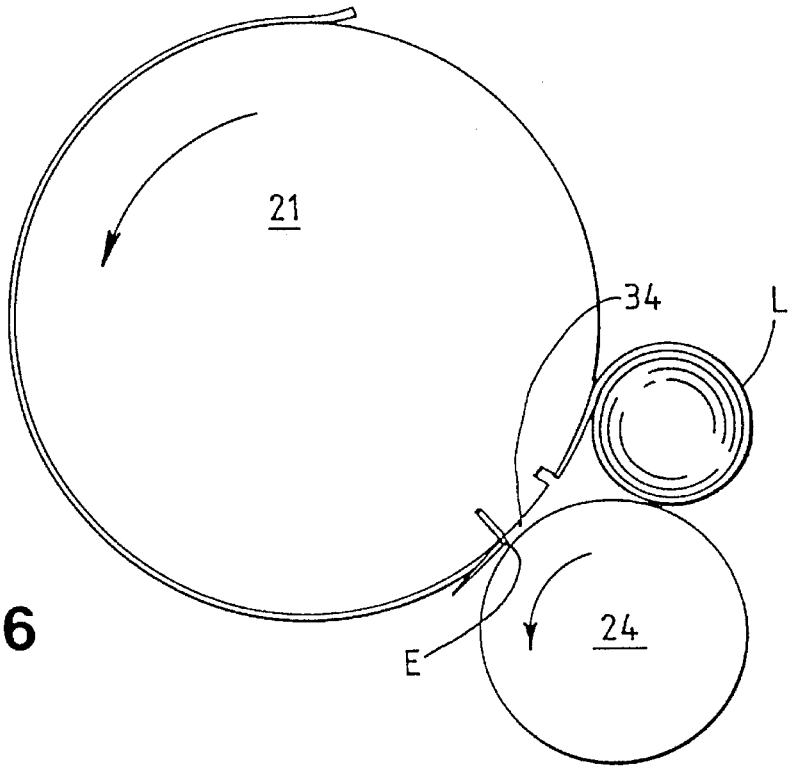
FIG. 6

FIG. 7A
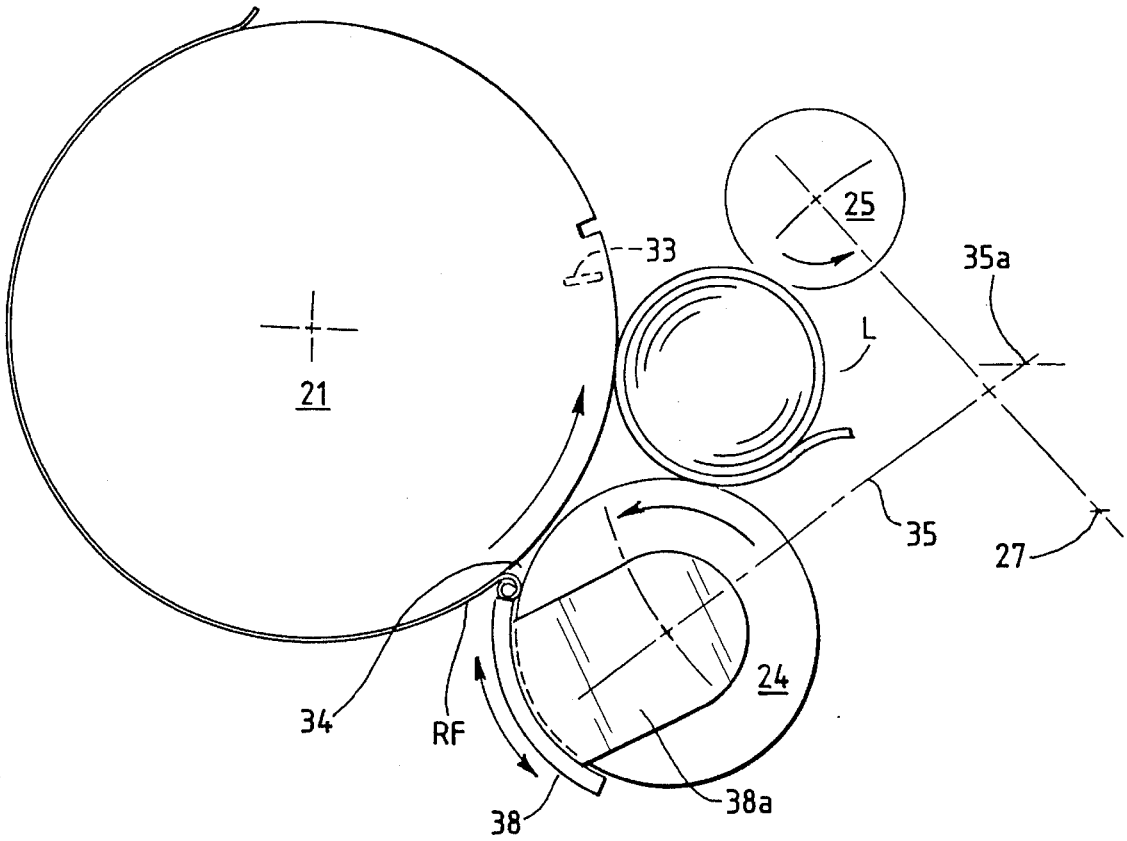
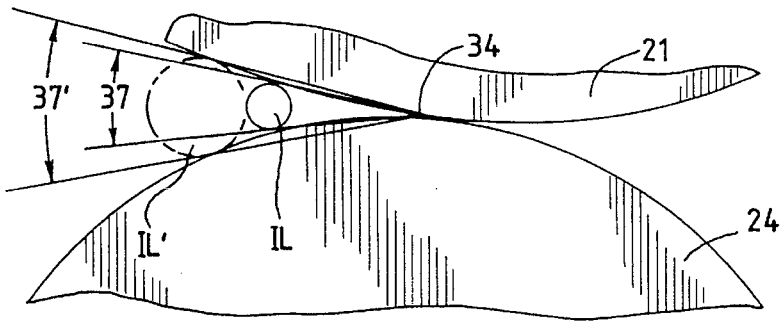
FIG. 7B

FIG. 10A
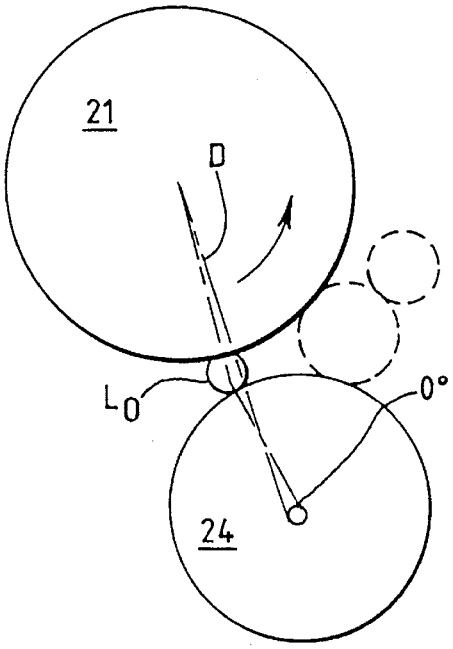
FIG. 10B
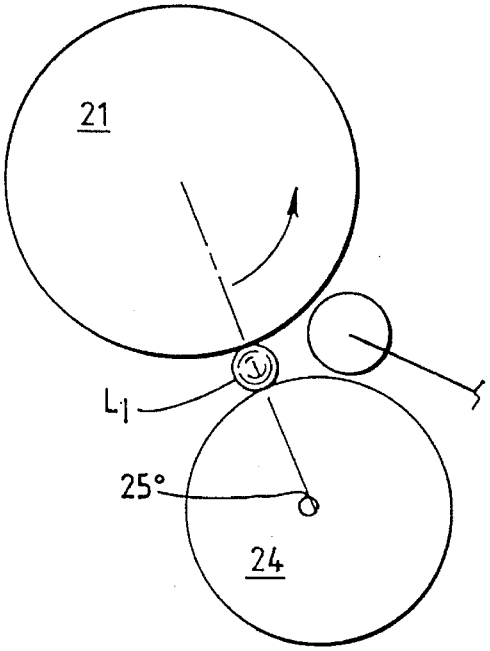
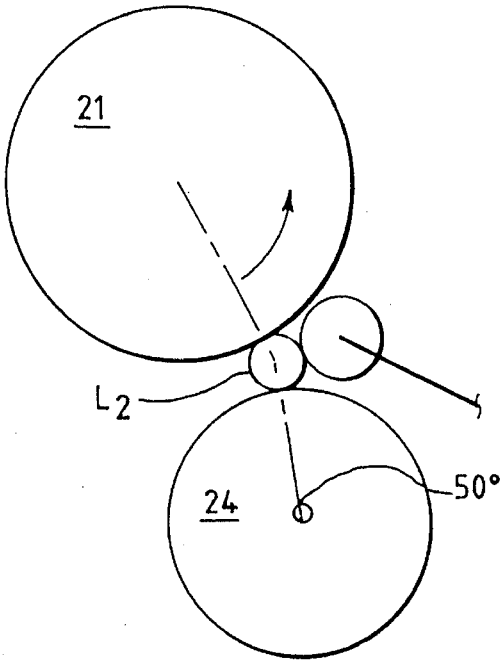
FIG. 10C
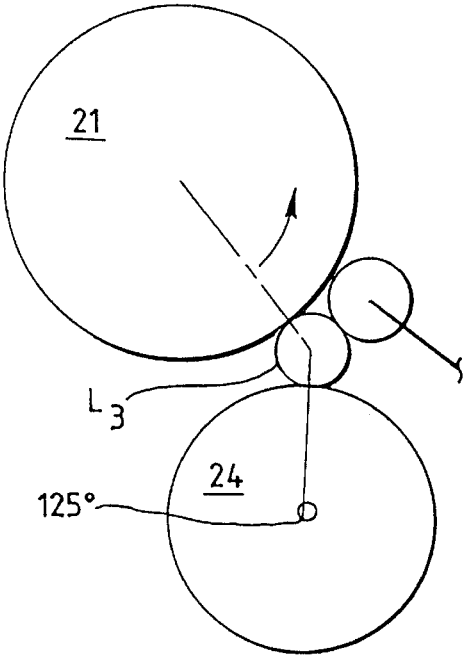
FIG. 10D

FIG. 10I
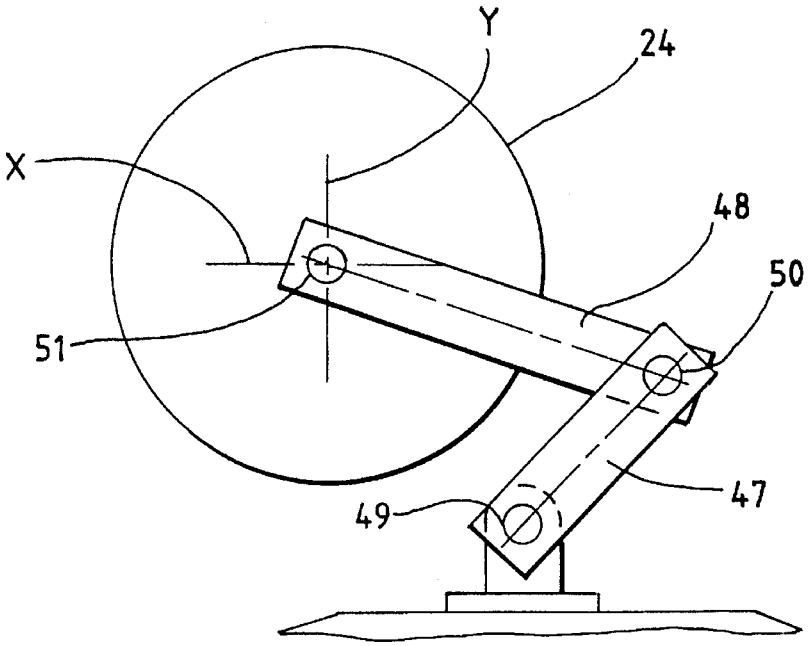
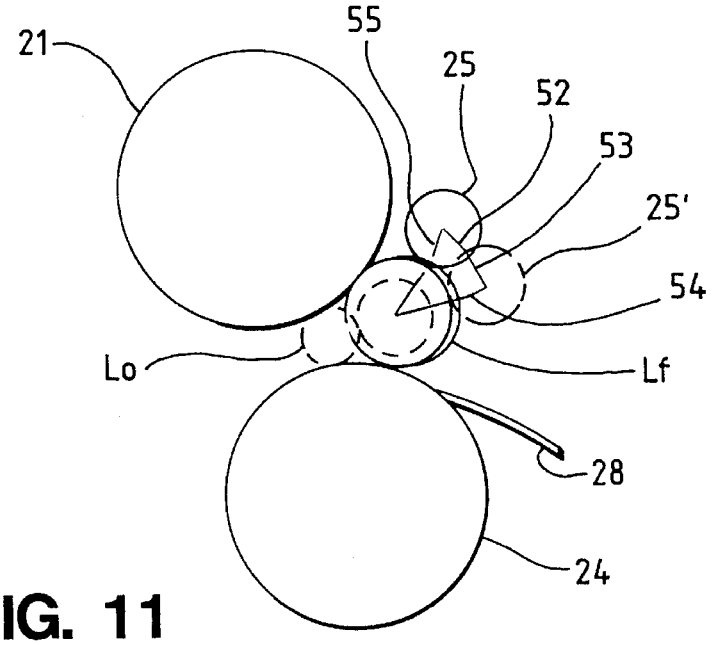
FIG. 11

FIG. 13A
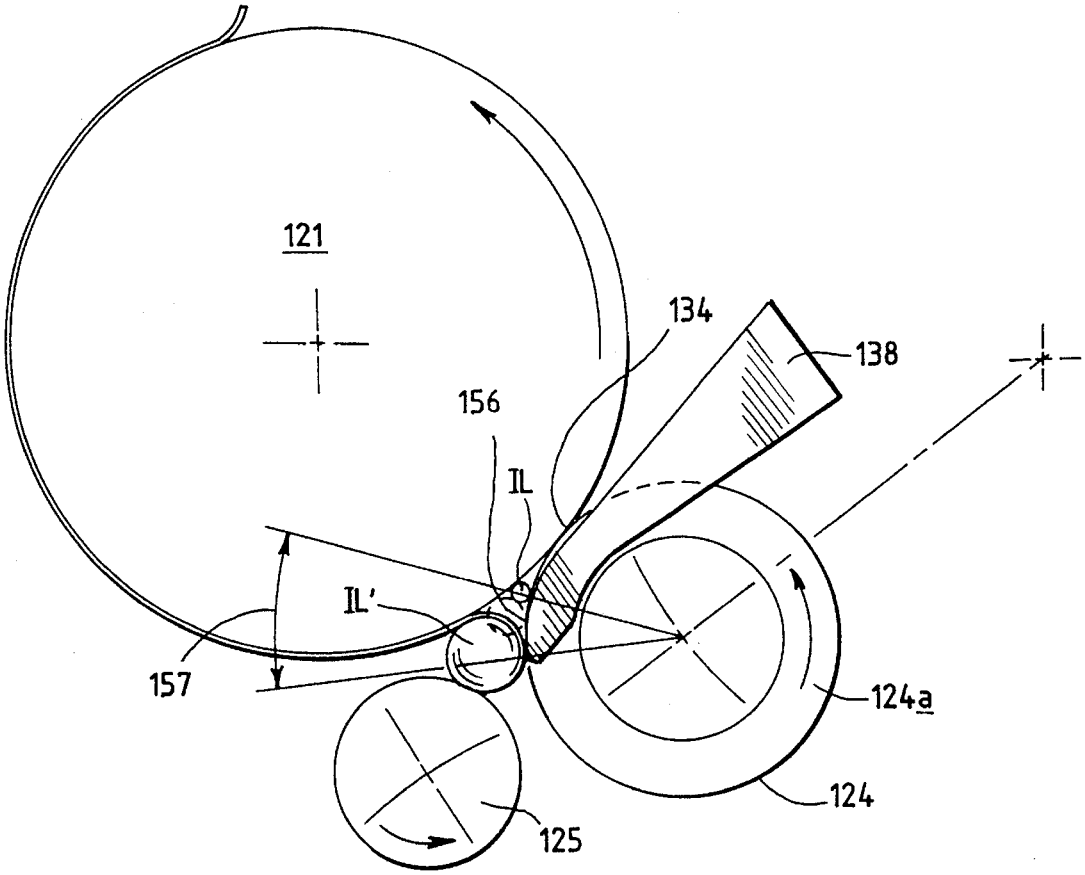
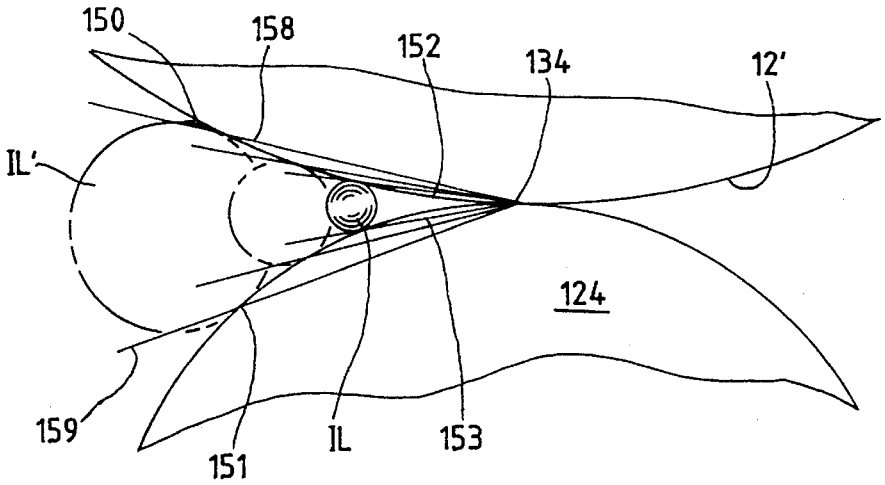
FIG. 13B

FIG. 14A
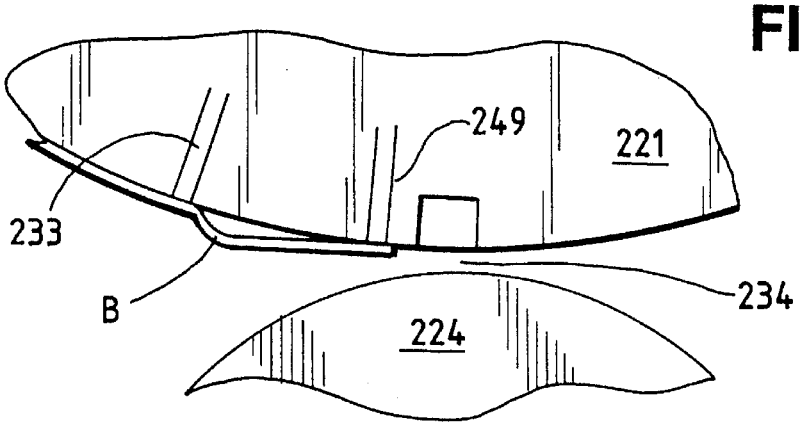
FIG. 14B
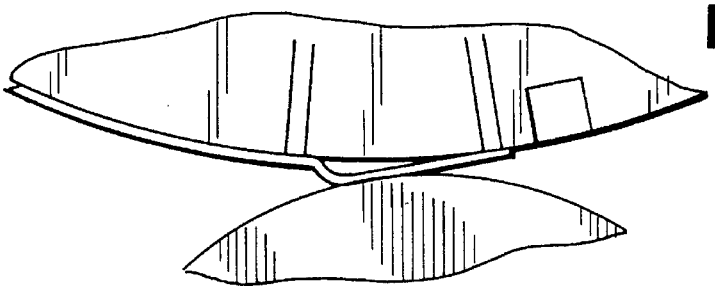
FIG. 14C
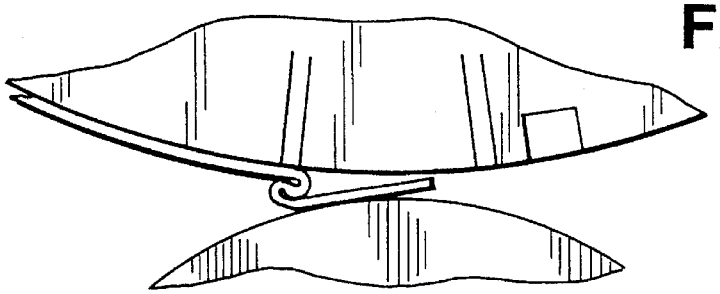
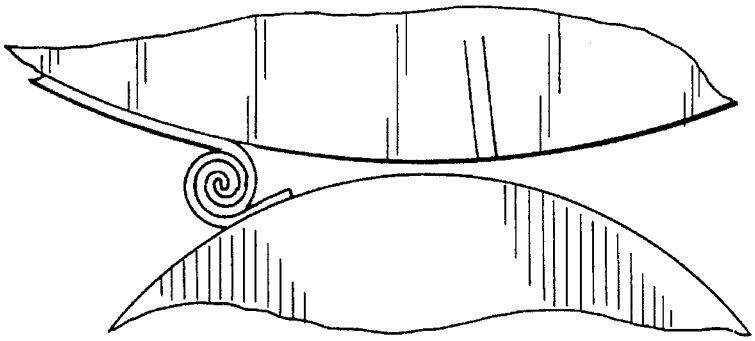
FIG. 14D

CORELESS SURFACE WINDER AND METHOD

This application is a continuation-in-part of application Ser. No. 08/108,105 filed Aug. 16, 1993, U.S. Pat. No. 5,402,960 and of Ser. No. 08/019,074 filed Feb. 18, 1993, U.S. Pat. No. 5,370,335.

BACKGROUND AND SUMMARY OF INVENTION

This invention relates to a coreless surface winder and method and, more particularly to a winder that does not use a core or mandrel but which produces a solid roll, i.e., there is no hole in the center with the resulting retail-size roll being "coreless". As such, the product is considered "environmentally friendly" in that there is less packaging material required and no core to dispose of.

Surface winders operate on the exterior of the paper being wound into a log and usually employ a three drum or roller cradle for this purpose—see, for example, co-owned U.S. Pat. No. 4,828,195.

The three drums usually include first and second winding drums and a pivotally mounted rider drum. Historically, a core is introduced into the nip between the two winding drums where it becomes enveloped with the web being wound—with the wind being completed when the incipient log is cradled among the three drums. The log generally is of a length to provide a plurality of retail size rolls—each being about 4" (100 mm) to 5" (125 mm) length. These logs are continuously wound at high speed generally 2500–3000 fpm (750–900 mpm) resulting in 20–30 logs per minute having axial lengths of from about 100" (3 m) to about 200" (6 m).

The improvement of this invention over the earlier filed curved plate innovation in Ser. No. 08/108,105 is the drum to drum transfer which keeps the incipient log product parallel to the drums. This minimizes the wrinkling and tension problem. In coreless surface winding the product is folded over itself to initiate the rolling start of wind. The drum-to-drum initiated start of wind provides instantaneous acceleration into rotational speed, which is contained in the parallel nip. This is in contrast to the drum and curved plate method start of wind where the incipient roll is accelerated into one-half rotational speed and one-half linear speed, which tends to move non-parallel to the nip due to the inconsistencies in web material and diameter buildup.

The instant invention makes use of a pair of winding drums located in close proximity to each other and where one drum is equipped with a slot for cutoff and means rearward of the slot for carrying the severed web toward the nip between the two drums where winding begins. More particularly, the severed web is folded on itself along a line defined by the carrying means. The nip or distance between the two winding drums is advantageously a function of the thickness of the web material, being less than twice the thickness of the web material. Where the web is wound "downstream" of the nip a minimum nip of one web thickness is required to allow the end tail of the finished roll to go through the nip. Where the web is wound upstream of the nip, the nip spacing can be minimal.

According to the invention, there is no core and the wind is started by a rubbing motion brought about by introducing a folded leading edge of a severed web toward the controlled nip area between the two winding drums. At the speeds involved, it is only a fraction of a second for the leading edge to form an incipient roll or log and then travel into the conventional three drum surface winder cradle. As the leading edge of the severed web enters the nip area, both winding drums are rotating in the same direction—counter-clockwise, for example.

The phenomenon of a reverse folded leading edge is illustrated in detail in co-owned patent RE 28,353. There, a portion of the web rearward of a severed leading edge is immobilized against the surface of a bedroll. When that occurs, windage and centrifugal force curl the leading edge on itself back to the immobilizing means which may be vacuum, pins, etc. In the '353 patent at transfer, pushers engaged the folded leading edge against the glue-equipped cores. An advantage of the folded web, as described in the '353 patent, is the entrapment of one ply within the other when two ply tissue is being wound. If the leading edge were not controlled, it could fly away under the influence to the above mentioned factors: windage and centrifugal force—and stop the winding.

The advantage of the folded web in the instant invention is to increase to at least two thicknesses (and with its usual width) to cause the leading edge of the web to roll back onto itself, across the width as it enters the nip area. So, it is clear that the operation of prior art winders is completely different from that of the instant invention. Hence, another advantageous use of the reversely folded leading edge portion has been found so as to be able to start a surface wind and thereby provide solid log.

The invention also includes means for negating or limiting uncontrolled movement of the incipient log away from the nip upon increase of the contact angle of a incipient log—which stems from increase in incipient log diameter. In the illustrated embodiments, this means takes the form of (a) means for the moving winding drums as by moving one drum away from another which is especially advantageous for relatively slow speeds and/or (b) finger means for applying pressure to the incipient log.

The contact angle referred to is the angle included between lines connecting the point in the middle of the nip with the points of tangency made by the contact of the winding drums with the incipient log. The precise location of the tangency or contact points can vary somewhat depending upon the compressibility of the web making up the incipient log and the geometry of the system.

The invention further includes a means and method for minimizing slippage in a solid-wound roll. Slippage has been known and tolerated for a long time—see U.S. Pat. No. 1,719,830. The minimizing of slippage between the web being wound and use of the winding drums includes providing one of the drums with a unique speed profile. Further details of the speed profile in a core-type winder can be seen in my co-pending application Ser. No. 08/019,074 filed Feb. 18, 1993, now U.S. Pat. No. 5,370,335. There, in a similar surface winder but operating on a series of cores, I provided control means for changing the rotational speed of the lower winding drum to substantially eliminate slippage between the lower winding drum and a web roll being wound on a core. This consisted of providing a speed profile in the lower winding drum wherein the speed of the lower winding drum is decreased just prior to the beginning of each winding cycle to advance a partially wound roll toward and through the winding drum nip and thereafter increasing the speed of the lower winding drum as a function of the increasing diameter of a partially wound roll.

This invention further makes available an advantageous taper winding, i.e., portions of rolls being gradually harder or softer than other portions—by virtue of modifying the speed profile. Further details of and other advantages applicable to both core and coreless wound rolls can be seen in my co-pending application Ser. No. 08/019,074, filed Feb. 18, 1993, U.S. Pat. No. 5,370,335 and reference may be had thereto for additional details not found herein.

The previously mentioned movement of one winding drum is especially advantageous in this connection by being moved through a closed orbit. Still further, the slippage between one winding drum and the web being wound resulting from advancement of the web central portion, viz., the folded over portion and its consequent buildup into an incipient log, is advantageously minimized by changing the operation of the rider roll—either by giving it a speed profile or by moving it through a closed loop or both. This is done by giving the rider drum an speed profile somewhat similar to that of one of the winding drums—and also, cumulatively or alternatively, moving it through a closed loop each cycle.

Other objects, advantages and details of the instant invention may be seen in the ensuing specification.

BRIEF DESCRIPTION OF DRAWING

The invention is described in conjunction with the accompanying, in which

FIGS. 4–6 are views essentially similar to FIG. 3 but depicting the winding in subsequent stages thereof; for example FIG. 4 shows the development of the reverse fold on the leading edge portion of the transversely severed web as can be appreciated from the fact that the upper winding drum has rotated from having the cutoff slot at the twelve o'clock position to about a 10:30 position;

FIG. 5 is another fragmentary view like FIG. 4 and shows the cutoff slot at about a 6:30 position;

FIG. 6 shows the slot at about a 5:00 o'clock position and where the folded leading edge is entering the nip area between the two winding drums;

FIG. 7A is an enlarged fragmentary side elevational view showing the completed log in the three drum cradle and the newly severed web in its initial stage of winding while FIG. 7B is an enlarged fragmentary view of the central portion of FIG. 7A and illustrates the contact angle resulting from movement of the incipient log away from the nip;

FIG. 8 is a view similar to FIG. 7 but slightly later in the winding process while

FIG. 11 is a side elevational somewhat schematic and similar to FIG. 8 which illustrates the closed loop or orbit operation of the rider drum providing further advantageous operation of the inventive winder.

FIG. 13A is a view similar to FIG. 12 but slightly later in the winding process while 13B is an enlargement of a central portion of FIG. 13A; and FIGS. 14A–D are views similar to FIGS. 11A–D but of an alternative way of starting the wind.

DETAILED DESCRIPTION

Figure 1:
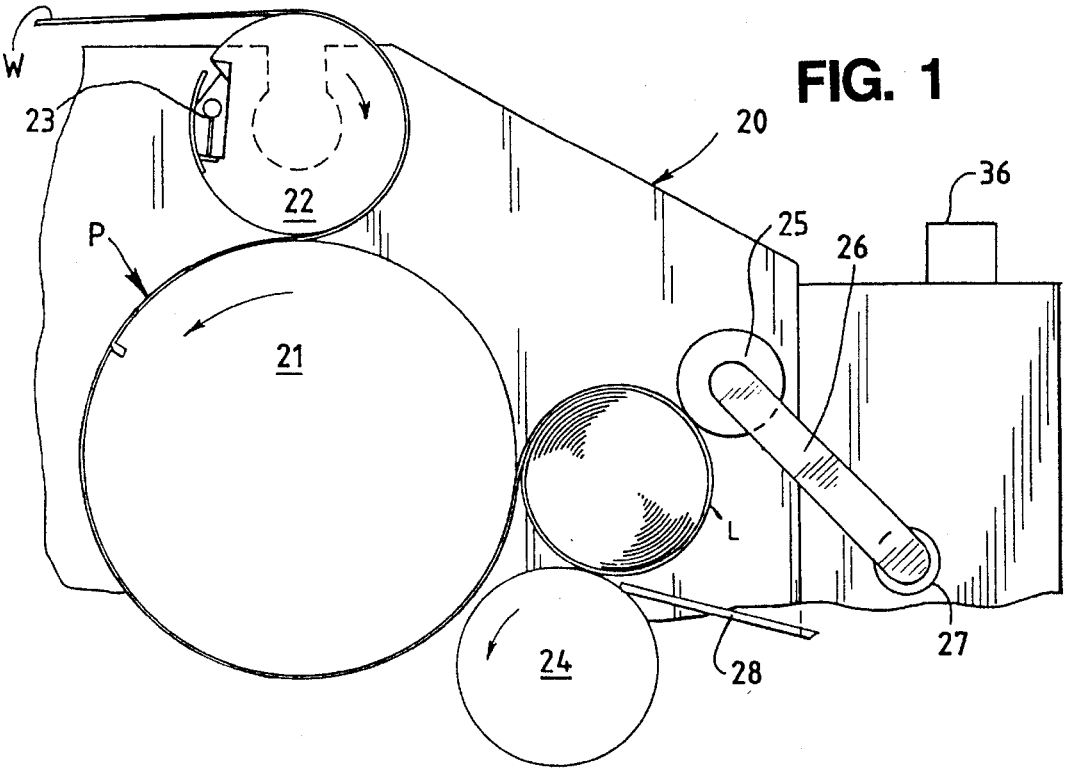
FIG. 1 is a side elevational view, somewhat schematic, of a winder embodying features of the invention.
Figure 2:
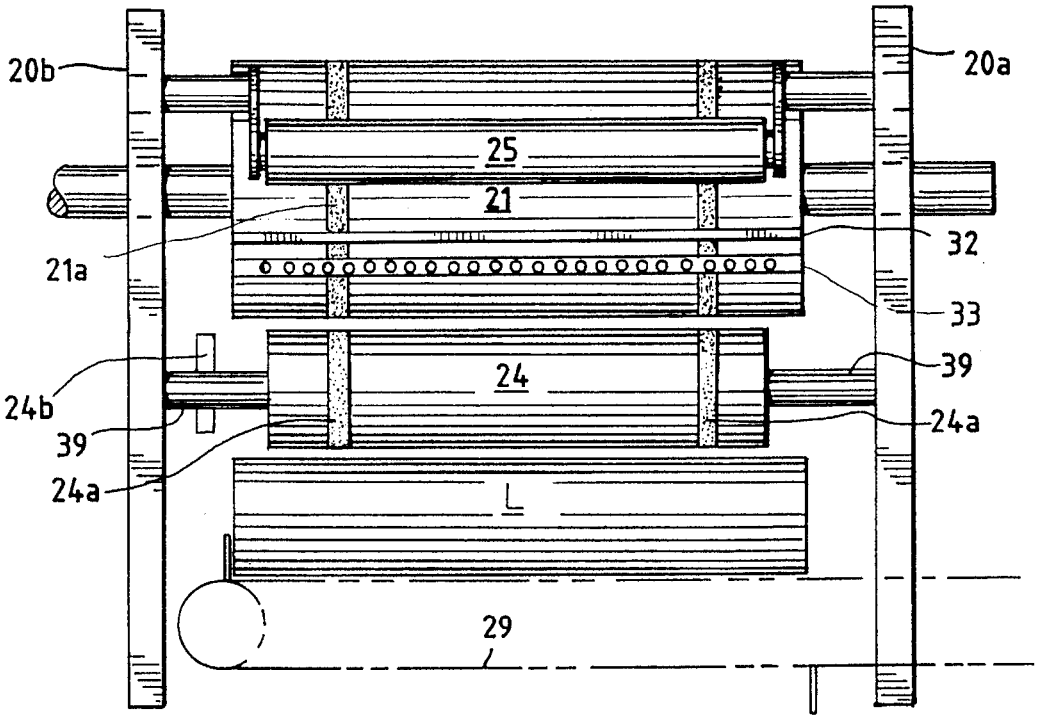
FIG. 2 is an end elevational view of the winder of FIG. 1 in what might be considered a "developed" view, i.e., the various drums being spread apart so as to better illustrate their arrangement.

In FIG. 1, the numeral 20 designates generally a frame which is shown fragmentarily but which includes the usual side frames 20*a* and 20*b*—see FIG. 2. Additional details may be seen in co-owned Patent RE 28,353. The frame 20 rotatably carries a bedroll-type drum 21 which is in the path of travel P of the web W—see the central left of FIG. 1.

The web W in traveling within the frame 20 toward becoming convolutely wound log L travels with a knife drum 22 before engaging the drum 21. The knife drum 22 is equipped with an emergent knife means 23 for transversely severing the web W so as to terminate one winding cycle and start another.

The winding drum 21 is one of two winding drums for surface winding—being accompanied by a second winding drum 24 —lower as shown. Completing the three drum cradle conventionally employed in surface winding is a rider drum 25 which is supported on an arm 26 pivotally mounted on the frame as at 27. When the log L is completed it is carried by an inclined table or ramp 28 for further processing as by a takeaway conveyor 29—see the bottom of FIG. 2. The takeaway conveyor 29 moves the logs L transversely of the path followed by the web W and usually into a log saw (not shown). At the saw, the log is severed into retail size lengths and thereafter packaged. The three drum cradle and accompanying elements thus far described are generally conventional.

The First Embodiment as seen in FIGS. 3–6

Figure 3:
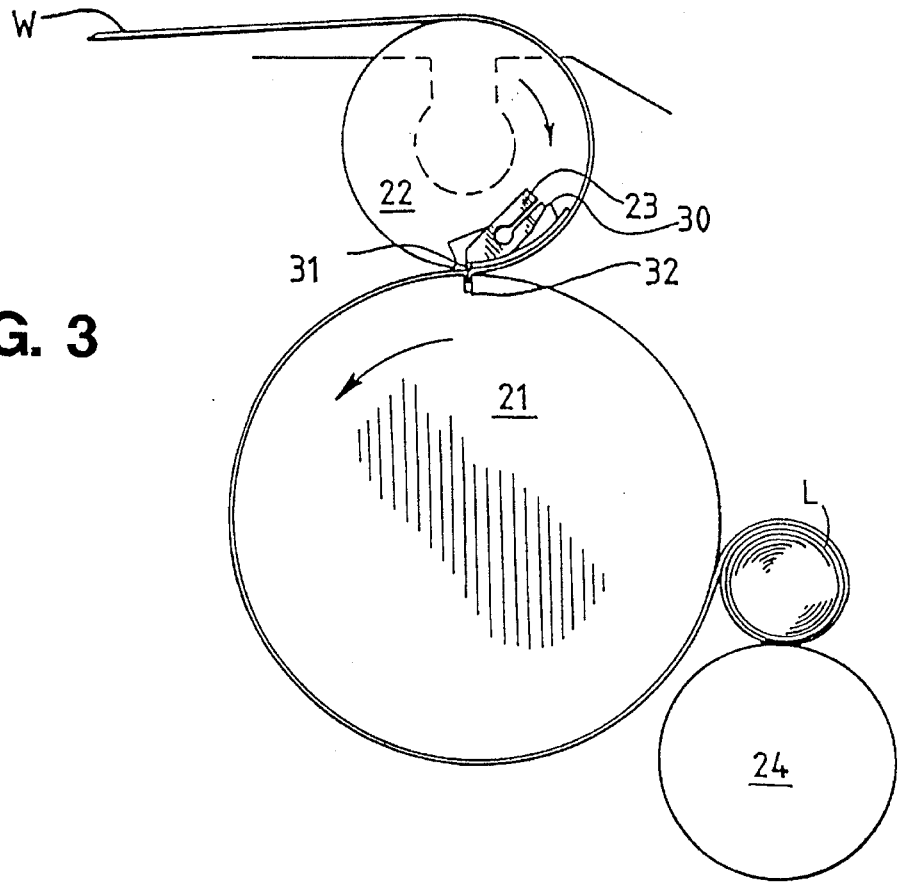
FIG. 3 is an enlarged fragmentary view of a portion of FIG. 1 and shows the cutoff of a web which signals the beginning of the winding of a new log according to the invention.

The initial stages of the invention can be appreciated from a consideration of FIGS. 3–6 with FIG. 3 illustrating the cutoff wherein the knife means 23 of the knife drum 22 is actuated as by a cam 30 so as to cause the knife element 31 to enter the slot 32 in the upper winding drum 21.

Figure 4:
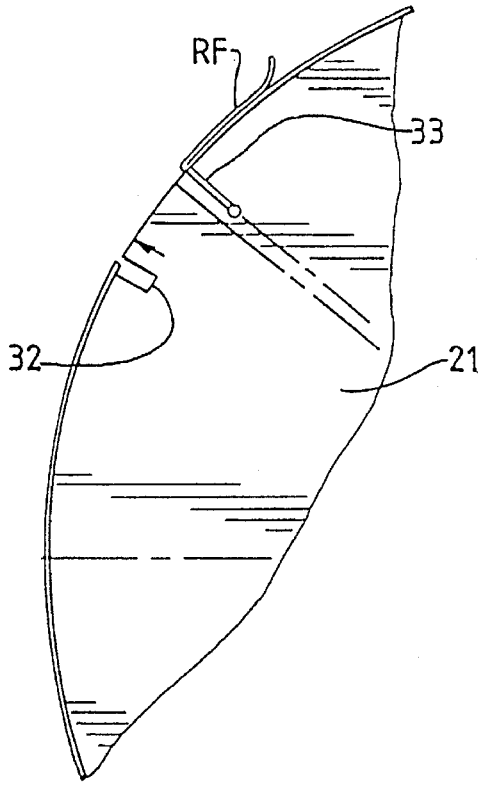

In FIG. 4, there is seen a web carrying means 33—illustrated as a vacuum port and which is located a spaced distance rearwardly (in the direction of drum rotation) of the slot 32 in drum 21. The web carrying means 33 includes a transversely extending series of vacuum ports—see FIG. 2 in the upper central portion thereof. This results in the development of a reverse fold as at RF in the upper portion of FIG. 4.

In FIG. 5, as the drum 21 continues its rotation—counterclockwise as shown—the leading edge E developed by the reverse fold RF is still aligned with the vacuum port 33 and is approaching the nip 34 that exists between the drums 21, 24.

In FIG. 6, the orientation of the drums 21, 24 is slightly later than the showing in FIG. 5 but still in the beginning of the wind. The leading edge E is now in the nip area 34 and about to curl on itself—as will be explained in conjunction with FIG. 7A.

Figure 8:
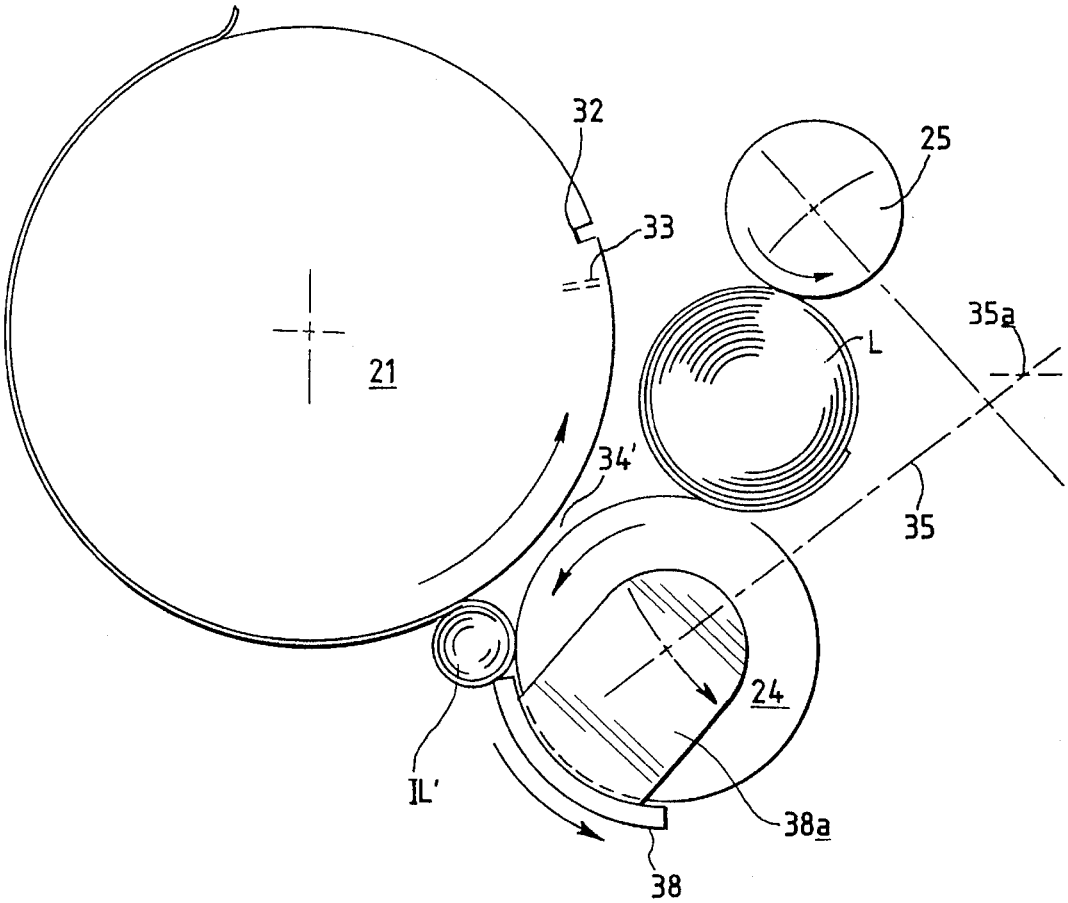

As Further Seen in FIGS. 7–9

In FIG. 7A, the machine elements and incipient log product are at a stage slightly later than that depicted in FIG. 6. In real time, this is a matter of a fraction of a second. The actual speed is a substantial factor when the invention makes use of a movable lower or second winding drum 24. In FIG. 7A this pivotal movement capability is indicated schematically by a pivot arm 35 which is pivotally mounted on the frame as 35*a*. A controller 36 (see the upper right in FIG. 1) regulates the movement and speed of drum 24 as other timed members, viz., knife cam 30, etc.

The surfaces of the upper and lower winding drum 21, 24 advantageously have a coefficient of friction great enough to drive the incipient log product (i.e., roll the log product on itself) when the folded leading edge E is introduced into the nip area 34. This can be done a variety of surface finishes for the drums 21, 24. For example, the surfaces may be matte finished, they may have an entire covering of with a sand paper type finish or a high friction urethane or rubber covering. Circumferential bands of the friction material also achieve the advantageous friction surfaces—see the schematic band showing at 21*a* and 24*a* in FIG. 2.

The transfer sequence views of FIGS. 7A and 8 show the start of wind where the product begins to roll over on itself. It has been found that surface speeds of the drums 21, 24 of near matched speed work well at the start of wind. As the product builds in diameter, to approximately 0.25 inches (6 mm) it is held in the nip 34 of the two drums by the friction of the growing diameter. After approximately 0.25 inch diameter is reached the diverging or contact angle is increasing so as to move the product out of the nip 34, thereby reducing the grip of the product in the nip. The actual diameter before the friction grip is lost is a function of the drum diameters,—the larger the drum diameter the larger the product diameter can be before the contact angle reduces the friction hold. The drum friction surface also determines the roll diameter where grip lessens substantially.

The increase in the contact angle is illustrated in FIG. 7B. At a small diameter of incipient log IL, the contact angle is small as at 37 while the larger diameter incipient log IL' has a larger contact angle 37'.

At the lower speeds it is possible in the initial period of the wind to avoid the reduction of friction hold stemming from contact angle increase by opening the gap between the two drums and, by speed change of the lower drum, move the product center, i.e., through the nip. This keeps a grip on the incipient log until it reaches a diameter where the rider drum 25 can make contact. At higher speeds however, it is dynamically difficult to move the winding drums apart fast enough to keep the product in the nip only by friction. In this case, friction fingers 38 are used to create a forward force, i.e., a force directing the incipient log downstream so as to keep the product moving toward the nip until the lower drum 24 can be moved away from the upper drum 21 to advance the product. The force from the fingers 38 is developed by their being close to the lower drum 24 so that the product would not be pinched between the fingers 38 and the drum 24. This is ensured by positioning the pivot arm 38*a* on the axis of the drum 24.

The fingers 38 are pivotally mounted on arms 38*a* which may be resiliently carried, i.e., spring loaded as at 24*b*, on the shaft 39 of the lower drum 24—see FIG. 2. In FIG. 8, the fingers 38 have pivoted slightly counterclockwise to accommodate the larger log IL' and the lower drum 24 has also pivoted slightly counterclockwise to enlarge the nip to 34' (see FIG. 8).

So, if time is available to open the gap between the drums 21, 24, or change the speed of one drum, or a combination of both, no friction fingers are required. As speeds increase and it becomes dynamically difficult to move the drums apart, fingers work well to drive the product into the nip. Once the drums have separated, the product can be moved over center via speed change of the lower drum. Then, the remainder of the product can be wound using the "speed profile" of copending application Ser. No. 08/019,074, filed Feb. 18, 1993, now U.S. Pat. No. 5,370,335, and while it is in contact with the rider drum 25—see FIG. 8A.

The controller 36 changes the rotational speed of drum 24 to substantially eliminate slippage between the second winding 24 drum and a web log being wound and also provide a speed profile in the second winding drum wherein the speed of the second winding drum is near match speed at the start of the wind, then decreased quickly after the beginning of each wind cycle to advance a partially wound log toward and though the nip 34 and thereafter increased as a function of the increasing diameter of the partially wound log. This can be appreciated from a consideration of the curve 40 in FIG. 8A.

Speed Profile and Modifications

Figure 8A:
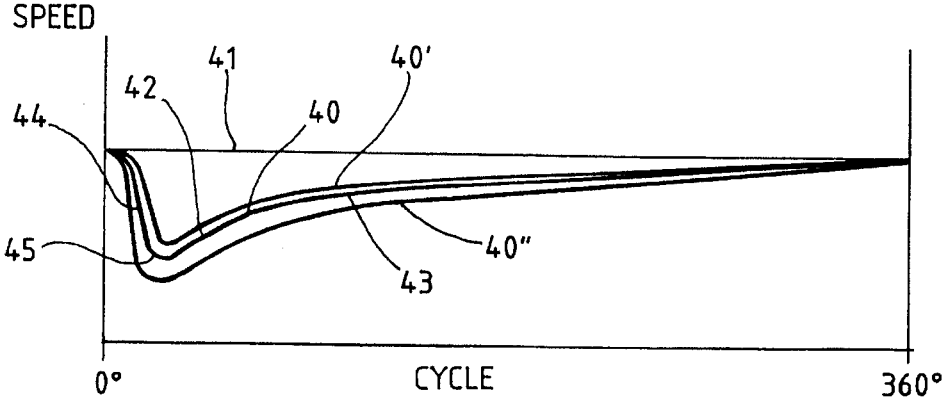
FIG. 8A is a graph of the speed profile or curve developed in one of the winding rolls for minimizing slippage and flanking that are curves showing speed profiles for tighter (upper) and looser (lower) winds.
Figure 9A:
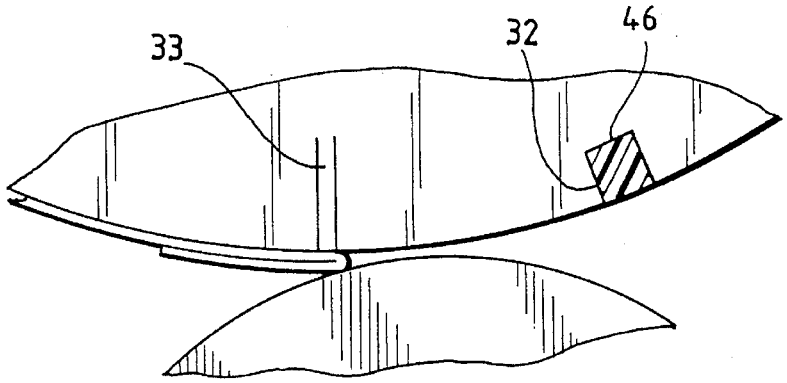
FIGS. 9A–D are enlarged fragmentary side elevational views of the web being folded on itself and being wound into an incipient log.
Figure 9B:
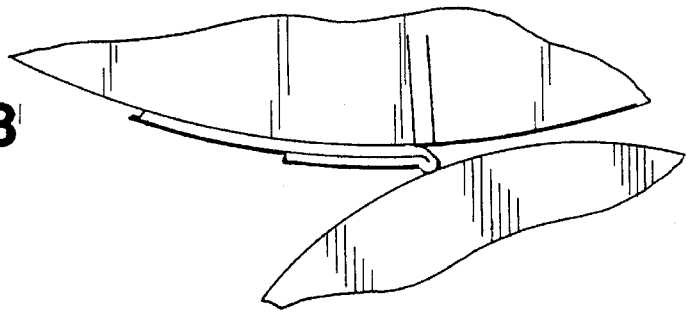
Figure 9C:
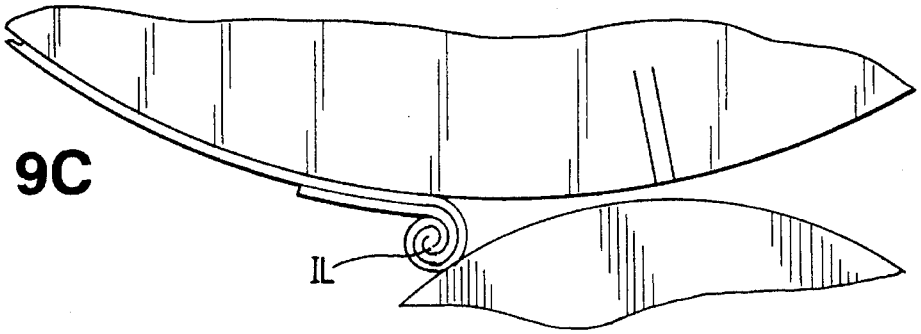
Figure 9D:
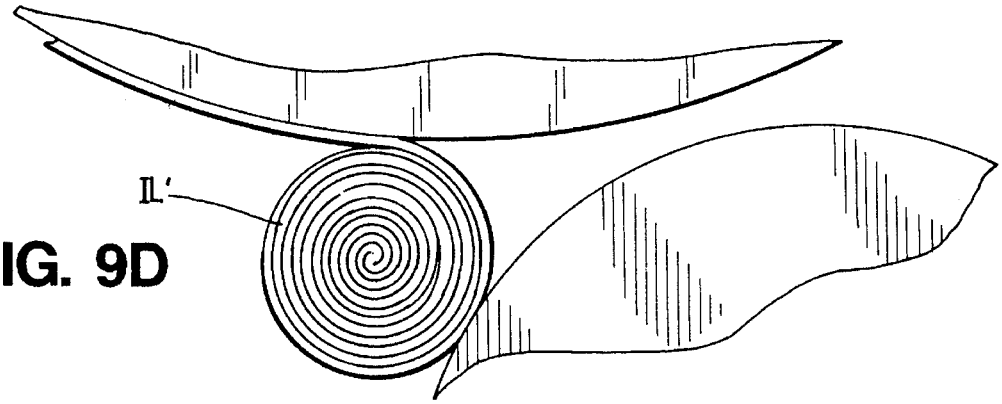

In FIG. 8A, it will first be noted that the numeral 41 designates the flat speed profile of the upper winding drum 21. The numeral 40 designates the speed profile of the lower winding drum 24. For example, the lower drum speed 40 decreases fairly rapidly over the initial part of the wind as at 44 so as propel the now partially wound roll through the nip space 34' (FIG. 8). Thereafter, the speed of the second winding drum increases following a path designated 42 and 43 which approaches but does not precisely equal the surface speed of the first winding drum 21. However, at cut-off and the start of a new cycle of winding, I find it advantageous to have a match between the upper and lower drum speeds. As the incipient coreless log passes through the nip, the speed is advanced as at 45. Some variation in speed is permissible—and even advantageous—depending upon the geometry of the system and the product being processed.

This is particularly true when a taper wind is desired, i.e., the hardness or softness changes in proceeding away from the roll interior. The lower curve 40" of the group of three lower curves illustrates a taper wind which is looser or of lower tension at the start of the wind. This stems from the fact that the product moves out of the nip 34' a little earlier than it does when the lower winding roll is operating under the conditions of curve 40. This results in less compression and a softer wind, viz., less tension. This is advantageous in avoiding telescoping during the wind. Telescoping is where the center or "core" area tends to move axially—like an open telescope. With the softer wind at the beginning of the cycle, the product diameter would tend to get larger. To get a prescribed diameter, a tighter wind toward the end of the cycle is employed.

Conversely the upper curve 40' is of a taper wind that is tighter at the start and looser at the end. The tighter wind stems from the fact that the incipient log stays longer in the nip area, therefore, the tighter wind. The speed of log movement is dependent on the speed difference between the two drums 21, 24. The closer the speed is to a match, the slower the movement of the incipient log and the tighter the wind.

The showing in FIG. 8 is merely illustrative of what can be two variations from the previously described speed profile based upon being a function of the increasing diameter of the log being wound. By suitable variation of the speed signal emanating from the controller 36, it is possible to localize the different "taper" in any position of the cycle, i.e., any annular portion, as desired and the taper may be either "softer" or "harder" than the remainder or even an adjacent annulus of the completed log.

For example, the tighter wind at the start of the cycle, viz., curve 40', is advantageous in providing more strength in the central area. This is an area of potential deflection during log sawing. A little more firmness internally supports the incipient log and the cutting or sawing operation is less traumatic to it.

After passage of the incipient log through the nip 34', the fingers 38 may be moved to their FIG. 7A position to be ready for the next log. And during the initial stages of the next wind, the fingers are pivoted toward the nip as seen in FIG. 8.

Of additional note, it may be advantageous for the cutoff slot 32 in the drum 21 to contain a resilient material to fill in the slot gap. On the first revolution after the start of the wind, the slot returns to the small diameter wound product and a loss of nip contact can create slippage, or the slot could even carry the small product through the nip. Besides being a resilient material, the filler could be a mechanical means to solidly close the gap. This is illustrated as at 46 in FIG. 9A.

The succeeding views 9B–9D show the development of the log IL' in somewhat exaggerated form of thicker web material but illustrate the principle of the invention.

Orbiting Lower Winding Drum

Referring to FIGS. 10A–G, the numeral 21 once again designates the upper winding drum while the numeral 24 designates the lower winding drum. This particular sequence of views demonstrates how the orbiting or closed path loop of movement of the lower winding drum can be used to achieve substantial elimination of slippage between the web being wound and the lower winding drum but without employing a speed profile of the nature previously described in conjunction with FIG. 8. In fact, the speed profile of the lower drum is a constant as can be appreciated from FIG. 10H where this is designated 41' in contrast to the speed profile of the upper drum which is designated 41. In other words, there is no variation of the speed of the lower winding drum 24 throughout a given cycle.

The effect of this in combination with the orbiting of the lower winding roll 24 as illustrated in FIGS. 10A–G is to provide a result equivalent to that developed by speed profiling the lower winding roll. For example, at the beginning of the cycle, which is designated 0° in FIG. 10A, it is seen that the incipient log $L_o$ is behind the dot-dash line D connecting the centers of the upper and lower winding drums.

As we progress through the positions it will be noted that the newly wound incipient log is moving slowly to the right while the lower winding drum 24 is orbiting in a closed loop rapidly clockwise. The movement is in a generally illeptical path but for reasons of simplicity, this is shown as a circle.

Figure 10E:
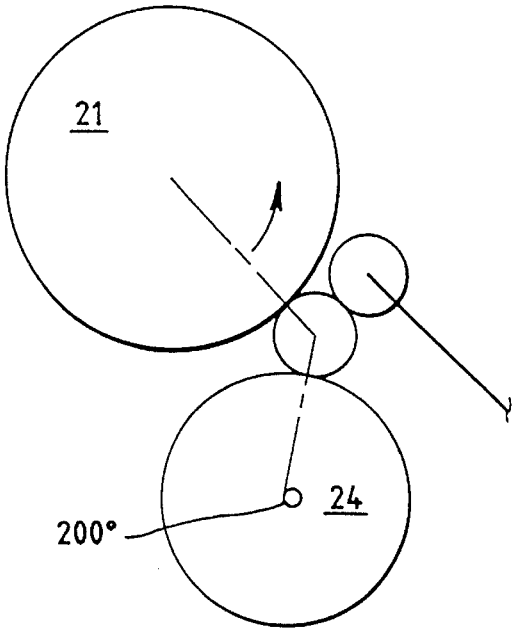
FIGS. 10A–G are a sequence of fragmentary side elevational views showing the effect of orbiting the lower winding roll in minimizing slippage the chart showing the difference in speed profiles is illustrated in FIG. 10H, and a schematic size elevational view of a two-bar mechanism for orbiting the lower winding roll is depicted in FIG. 10I.
Figure 10F:
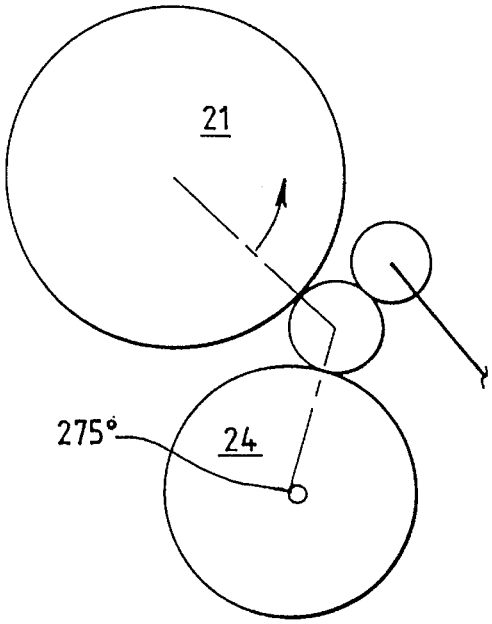
Figure 10G:
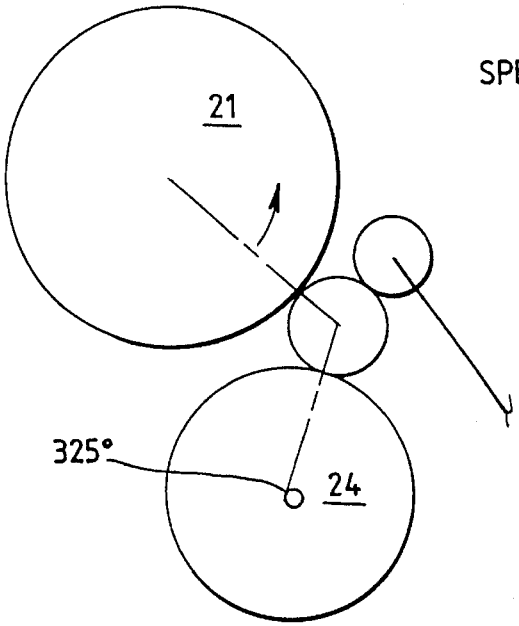
Figure 10H:
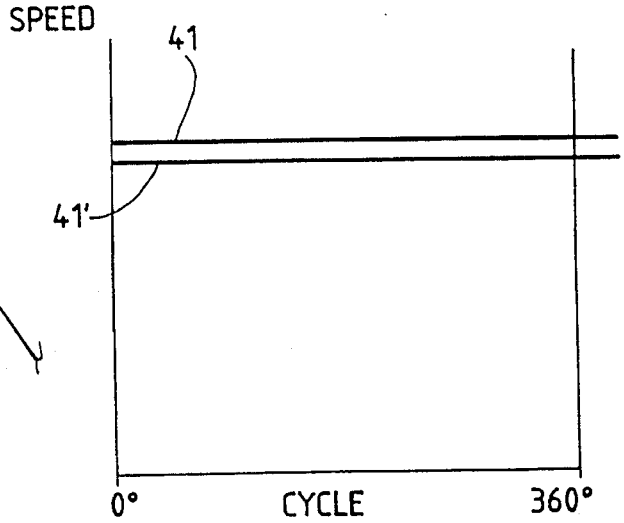

The movement can be appreciated from the sequence wherein FIG. 10B there has been a relatively small movement to the right of the log $L_1$ while the lower winding roll 24 has moved through 25° of the winding cycle. Then in FIG. 10C, there is again a relatively small movement of the log to the position $L_2$ while the lower winding roll 24 has moved through 50° of the winding cycle. In FIG. 10D, the log $L_3$ has moved again slowly toward the right whereas the drum 24 has moved through 125° of the winding cycle. In similar fashion the log is seen to progress more rapidly to the right as the winding drum 24 proceeds through the remainder of its orbit—with its drum center having moved to positions of 200°, 275° and 325° of the winding cycle in FIGS. 10E, 10F and 10G, respectively. Thus, this profiled movement of the lower drum provides an opportunity to use a linear speed differential between the upper and lower winding drums 21, 24, respectively as shown in FIG. 10I at 41, 46', respectively.

The means for achieving this operation so as to develop an advantageous alternative to the speed profile or an advantageous addition to the speed profile, i.e., the speed profile and the orbiting lower winding roll in combination, is illustrated schematically in FIG. 10I.

Now referring to FIG. 10I, the lower winding drum is again designated 24 and is mounted for movement relative to both horizontal and vertical axes X, Y so as to move through the orbit of FIGS. 10A–G. A variety of linkages can be employed for doing this, one simple linkage being a two bar linkage including arms 47, 48. The arm 47 is pivoted on the frame F at 49 and pivotably interconnected with the arm 48 at 50. The other end of the arm 48 is pivotly interconnected with the bearings 51 supporting the journals of the drum 24. Suitable actuators such as fluid pressure cylinders may be employed for moving the arms 47, 48 and thus the bearings 51.

The operation of the fluid pressure cylinders (not shown) is advantageously achieved through the use of a controller 26 as was previously pointed out relative to FIG. 1.

Orbiting Rider Drum

Referring to FIG. 11, the usual three drum cradle is illustrated with the upper and lower winding drums being designated 21 and 24, respectively. The rider roll 25 which has also been previously shown in FIG. 1 is seen to be in a variety of positions. The solid line position designated 25 is the position the rider drum occupies at the end of the winding cycle and just prior to the log $L_f$ starting its descent along the inclined plane or ramp 28.

The rider drum 25 is supported on a linkage mechanism operative to provide two degrees of freedom or movement as along both X and Y axes much the same as was illustrated in FIG. 10I relative to orbiting or elliptical movement of the lower winding drum 24. Here the orbit of the drum center is more in the nature of a spherical triangle shown in dotted line and generally designated 52. One leg 53 of the triangle 52 is seen to be somewhat arcuate stemming from the fact that the rider drum follows the contour of the log $L_f$. Thus, the log 53 is convex, i.e., outwardly arcuate relative to the exterior of triangle 52.

The second leg 54 is shown as a straight line based on the fact that the drums 21, 24 are of identical diameters. When this is the case, the center of the log moves in a straight line to the position 25'.

However, in most cases, the diameters are different—with the lower winding drum having the smaller diameter as shown in FIG. 1. In such a case, the log follows the lower drum and the log center therefore moves along an arcuate path. So also does the rider drum to press against the log along a line passing through the log center. Therefore, the rider drum 25 (and its center) moves along an arcuate path which is concave—viewed relative to the interior of the spherical triangle 52.

The third side 55 of the generally spherical triangle 52 is also arcuate, i.e., outwardly convex, and represents a fairly rapid movement following the contour of the upper winding drum 21 and the exterior contour of the final log $L_f$—reaching into tangency with the beginning log $L_0$.

The advantage of this system illustrated in FIG. 11 is the ability to contain the product within an approximately equilateral triangle between the upper and lower drums and the riding drum. Even though this has been the goal of previous three-drum cradles, typically done with a single pivoting arcuate movement, it has been achieved imperfectly because the single arcuate path departs substantially from the generally equilateral triangle made possible by practice of the invention of the embodiment of FIG. 11. For example, during the segment designated 54, the invention provides the best containment angle for stability of wind. At the end of the segment 54 and during the segment 53 it is advantageous to provide for discharge of the product by having the rider roll move out of a containment position relative to the almost completed log. Thereafter, the return is expeditious because of the unique geometry provided by this embodiment of the invention. Thus, this embodiment features a rider drum that has its center moving through a spherical triangle with generally two arcuate sides. It also may be advantageous to provide a speed profile to the rider drum 25.

The rider drum profile is different from that of the lower winding drum because of the different location and function. The rider drum 25 runs faster at the end of the cycle to insure removal of the roll product, i.e., the log L. Thereafter, the rider drum has a differently positioned profile because it is at a different distance from the upper winding drum 21 than the lower winding drum 24. After log ejection, the speed is returned to below the web speed and, thereafter, increased as a function of the increasing diameter of the log being wound.

Figure 12:
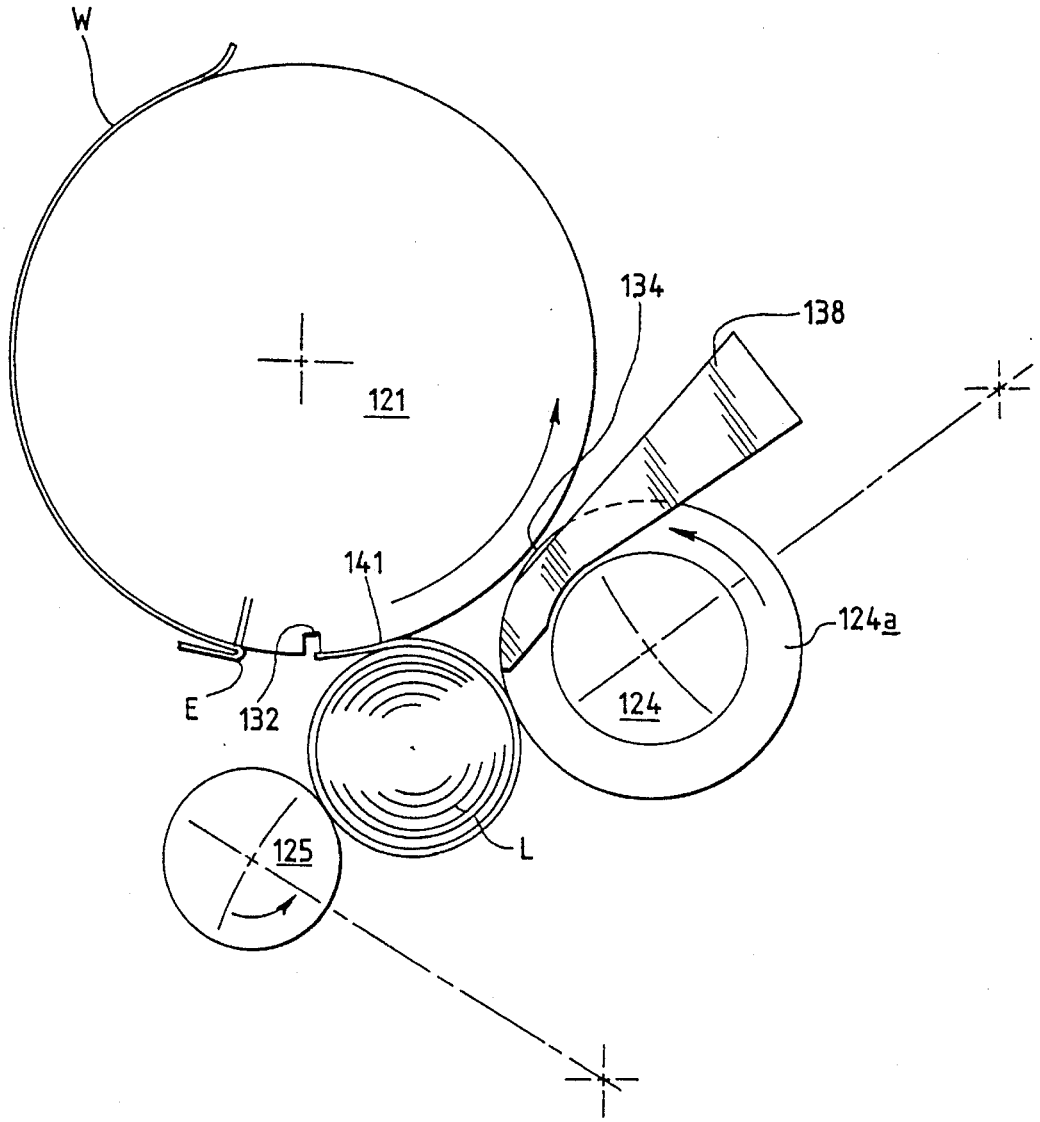
FIG. 12 is a side elevational view similar to FIG, 8 but of another embodiment of the invention

Second Embodiment—See FIGS. 12–13

A second or alternative embodiment is available where the distance between the upper and lower drums 121, 124 does not change, i.e., no movable winding drum. In this construction, friction fingers 138 are supported from the downstream side of the nip. The upstream side of the nip 134 between the winding drums 121, 124 is the side on which the web W approaches the nip. Here, however, the web W does not go through the nip 134. The fingers 138 may be supported in other positions depending on the flow of product. When supported as shown in FIGS. 12 and 13A, the drum 124 is equipped with annular grooves 124*a* to accommodate the fingers 138.

The fingers 138 extend to make contact with the product, i.e., incipient log, when it reaches the initial holding diameter of about 0.25 inches (6 mm) and stays in contact with the product until it builds to a diameter where the rider drum 125 can be moved into the FIG. 13A position (from the FIG. 12 position) at approximately 1.5–2.0 inches diameter of the incipient log. So, the fingers 138 urge the incipient log IL (see FIG. 13A) toward the nip 134 long enough to bring the rider drum 125 into position against the incipient log IL'.

As mentioned, in this embodiment, the roll being wound remains on the entering upstream side of the nip. The leading edge E of the cut product simply goes through the nip 141 (between the finished product L of FIG. 12 and the drum 121) and toward the nip 134 of the upper and lower drums 121, 124 where it starts to wind on itself.

The fingers 138 are each equipped with a friction surface 156 which has an angular extent as illustrated at 157 for contacting the incipient log IL. The friction surfaces of the fingers 38, 138 can be developed by a metallic or plastic material since very little coefficient of friction is required with stationary fingers (high friction material like that used on the winding drum could be too aggressive and could tear at the rotating incipient log).

Reference is now made to FIG. 13B where the increase in the contact angle is illustrated. As pointed out previously, the contact angle is defined by a pair of lines such as at 158 and 159 which extend from the center of the nip 134 and are tangent to the incipient log IL' at the points of tangency 150 and 151. The contact angle is seen to be much smaller when the incipient log IL is closer to the nip 134 as indicated by lines 152 and 153.

Again, it will be appreciated that the product or incipient log always remains upstream of the nip in this embodiment. Thus, the speed profile is, in effect, somewhat a mirror image of that shown in 8A at 40 for the embodiment of FIGS. 1–11. In other words, the speed profile for the embodiment of FIGS. 12 and 13A as seen in FIG. 12A has first an increasing speed characteristic at 144 and then at 145 starts to decrease along the portion 143 of the curve 140.

Figure 12A:
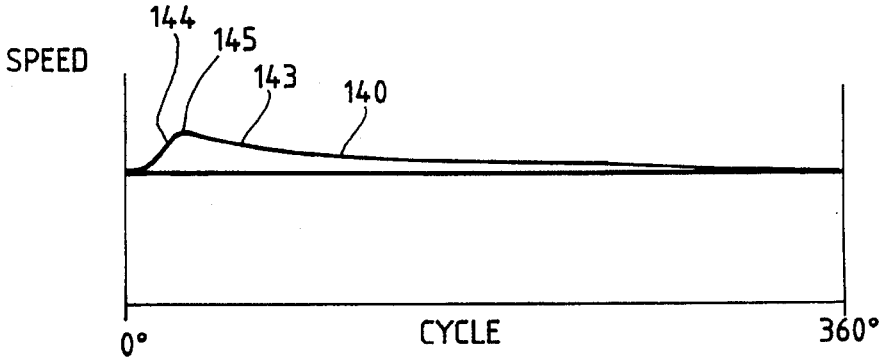
FIG. 12A is a view similar to FIG. 8A but of the FIG. 12 embodiment.

Similar to the depiction in FIG. 8A, the speed profile of FIG. 12A may be modified for taper winding under the influence of the controller 36. For example, where the drum 124 is rotated faster, the roll product becomes looser at the beginning of the cycle. This stems from the fact that, with the greater speed difference between the drums 121 and 124, the incipient log moves farther away from the point where the two drums are closest and thus winds more loosely. And to get a prescribed diameter of logs, the wind must be tighter toward the end of the cycle. So, in a curve above 140 in FIG. 12A, the converse of the situation of FIG. 8A occurs—because the drums are farther away from a speed match.

Both here and with the rider drum 25 of the preceding embodiment, there may be a speed profile variation—of speed variations above and below the profile employed to substantially eliminate slippage. Again, the character and location of the profile is determined by the geometry of the system and the character of the web being wound. However, in general, the farther away the variant curve is from a speed match—with the web, for example—the greater the speed differential, and the looser the wind.

FIG. 14

Other than the reverse fold described above, the leading edge of the web material can pass through the nip of the two drums 221, 224, if a small bubble is introduced in the web ahead of the vacuum port (see FIG. 14). As the bubble B enters the nip 234 of the upper and lower drums 221, 224, the bubble will fold over and initiate the rolling start of wind—pulling the end tail back through the nip into the wind as illustrated in FIGS. 14A–D.

The bubble B may be advantageously introduced through selective application of vacuum through supplemental ports 249. This is controlled by the controller 36 and may take the form of Model PIC 900 available from Giddings & Lewis located in Fond du Lac, Wis.

SUMMARY

The invention consists of apparatus for the convolute winding of a web log and includes a frame 20. Two basic embodiments are present, differentiated by the addition of 100 in the embodiment of FIGS. 12 and 13 over the same numerals without the 100 which have been applied to the embodiment of FIGS. 1–11.

The frame rotatably supports a first winding drum 21, 121. This first winding drum is equipped with slot means as at 32, 132. Provided alongside of the first winding drum 21 is a knife drum 22. The knife drum 22 and first winding drum 21 provide means for advancing a web W for travel with the first winding drum 21, 121. The frame also rotatably supports a second winding drum 24, 124 which is mounted in the frame 20 adjacent the first winding drum 21, 121 and located a spaced distance from the first winding drum to form a nip 34, 134. Still further, the frame provides pivotal support for a rider drum 25, 125 and which forms with the first and second winding drums a three drum cradle.

Means in the form of a vacuum port 33 or pins and the like are operably associated with the first winding drum 21, 121 for immobilizing a free portion of the web against the surface of the first winding drum. The immobilizing means 33, 133 is located a spaced distance from the slot means 32, 132 rearward in the direction of rotation of the first winding drum to cause a severed web to fold rearwardly as at RF—see FIG. 4. Further, the nip 34, 134 between the first and second winding drums is less than twice the web thickness. This may be even less in the case of the second embodiment.

In the embodiment of FIGS. 1–11 the nip has an upstream side and a downstream side with the upstream side being the side on which the web approaches the nip, and the rider drum 25 is on the downstream side of the nip.

Further, in the first embodiment, the apparatus includes control means 36 for selectively moving the second winding drum 24 toward and away from the first winding drum 21 to vary the spacing therebetween for passage through the nip 34 of a partially wound log—as well as importing a speed profile thereto. Additionally, the first embodiment has finger means 38 for urging an incipient log IL toward the nip 34. The frame 10 is equipped with means for pivotally mounting the finger means as at 35*a*. The pivotal mounting means at 35*a* is operative to maintain the finger means close to the second winding drum 24 and thereby prevent the incipient log IL from being pinched between the finger means 38 and the second winding drum 24. Still further in summarizing the embodiment of FIGS. 1–11, the first and second winding drums are equipped with frictional surfaces as designated at 24*a* in FIG. 2.

The second embodiment of FIGS. 12 and 13 has the rider drum on the upstream side of the nip 134. Again, the embodiment has finger means 138 for urging an incipient log IL toward the nip 134. Again, the first and second winding drums are equipped with frictional surfaces.

In both embodiments, the speed profile of the second winding drum can be varied as a function of the increasing diameter of the web roll on log being wound. In the first embodiment the speed profile is a reduced speed of the lower drum. In the second embodiment, the product remains on the incipient or upstream side of the nip and the lower drum speed profile is increased—see FIG. 12A.

In FIG. 8A relating to the first embodiment, the speed of the second winding drum 24 is relatively slow in comparison with the constant speed 41 of the first winding drum 21. This lower drum speed 40 decreases fairly rapidly over the initial part of the wind as at 44 so as to propel the now partially wound roll through the space 34' between the first and second winding drums 21, 24. Thereafter, the speed of the second winding drum follows a path designated 43 which approaches but does not precisely equal the surface speed of the first winding drum and which increases as a function of the increasing diameter of the partially wound roll or log. Then, at the beginning of the cycle or close thereto, the speed of the second winding drum (the lower drum shown herein) starts at close to match speed with that of the upper drum 21 but then drops as rapidly as possible as at 44 so as to be ready to start winding of the incipient log which is now downstream of the nip 34'.

The inventive method includes the provision of apparatus components as listed above and thereafter adjusting the nip between the winding drums to be less than twice the web thickness so as to wind the rearwardly folded severed web RF into an incipient log.

While in the foregoing specification a detailed description of the invention has been set down for the purpose of illustration, many variations in the details hereingiven may be made by those skilled in the art without departing from the spirit and scope of the invention.

What is claimed is:

1. Apparatus for convolute winding an elongated web log comprising a frame, a first winding drum rotatably mounted in said frame and equipped with a slot, means for advancing a web for travel with said first winding drum, a second winding drum rotatably mounted in said frame adjacent said first winding drum and spaced therefrom to form a nip, a rider drum pivotally mounted in said frame and forming with said first and second winding drums a three drum cradle, a knife drum rotatably mounted in said frame adjacent said first winding drum and equipped with knife means for engaging said slot for severing said web along a transverse line, means operably associated with said first winding drum for immobilizing a free portion of said web against the surface of said first winding drum, said immobilizing means being located a spaced distance from said slot rearward in the direction of rotation of said first winding drum to cause a severed web to fold rearwardly into an incipient log, and said nip between said first and second drums being less than twice the thickness of said web at least when said rearwardly folded web first enters said nip.

2. The apparatus of claim 1 in which said nip is greater than the thickness of said web when said rearwardly folded web first approaches said nip.

3. The apparatus of claim 1 in which said nip has an upstream side and a downstream side, said upstream side being the side on which said web approaches said nip, said rider drum being on the downstream side of said nip.

4. The apparatus of claim 3 in which said apparatus includes control means for selectively moving said second winding drum toward and away from said first winding drum to vary the spacing therebetween for passage through said nip of a partially wound log.

5. The apparatus of claim 4 in which said apparatus is equipped with finger means for urging said incipient log toward said nip.

6. The apparatus of claim 5 in which said apparatus is equipped with means for pivotally mounting said finger means, said pivotally mounting means being operative to maintain said finger means close to said second winding drum and thereby prevent said incipient log from being pinched between said finger means and said second winding drum.

7. The apparatus of claim 6 in which said first and second winding drums are equipped with frictional surfaces.

8. The apparatus of claim 1 in which control means are operably associated with said frame for changing the rotational speed of said second winding drum to substantially eliminate slippage between said second winding drum and a web log being wound and also for providing a speed profile in said second winding drum wherein the speed of said second winding drum is decreased from about an approximate speed match with said first winding drum at about the beginning of each winding cycle to advance a partially wound log toward said nip and thereafter increasing the speed of said second winding drum as a function of the increasing diameter of said partially would log.

9. The apparatus of claim 1 in which said nip has an upstream side and a downstream side, said upstream side being the side on which said web approaches said nip, said rider drum being on the upstream side of said nip.

10. The apparatus of claim 9 in which control means are operably associated with said frame for changing the rotational speed of said second winding drum to substantially eliminate slippage between said second winding drum and a web log being wound and also for providing a speed profile in said second winding drum wherein the speed of said second winding drum is increased from about a match speed with said first winding drum at about the beginning of each winding cycle to advance a partially wound log toward said nip and thereafter decreasing the speed of said second winding drum as a function of the increasing diameter of said partially wound log.

11. The apparatus of claim 9 in which said apparatus is equipped with finger means for urging said incipient log toward said nip.

12. The apparatus of claim 1 in which said first and second winding drums are equipped with frictional surfaces.

13. The apparatus of claim 1 in which said first winding drum is equipped with a second immobilizing means located intermediate the first mentioned immobilizing means and said slot, and control means associated with said second immobilizing means to form a bubble in said web free portion.

14. The apparatus of claim 1 in which control means are operably associated with said frame for changing the rotational speed profile of said second winding drum to substantially eliminate slippage between said second winding drum and a web log being wound.

15. The rewinder of claim 14 in which said control means also provides for deviating from said speed profile to taper tension wind wherein a portion of said log is of a tension different from another portion.

16. The apparatus of claim 1 in which means are operably associated with said frame for orbiting said second winding drum once each cycle of winding.

17. The apparatus of claim 1 in which means are operably associated with said frame for orbiting said rider drum once each cycle of winding.

18. The apparatus of claim 1 in which means are operably associated with said frame for orbiting said second winding drum once each cycle of winding and for imposing a speed profile on said second winding drum to substantially eliminate slippage between said second winding drum and a web log being wound.

19. Apparatus for convolute winding an incipient web log comprising a frame, a first winding drum rotatably mounted in said frame and equipped with a slot, means for advancing a web for travel with said first winding drum, a second winding drum rotatably mounted in said frame adjacent said first winding drum and spaced therefrom to form a nip, a rider drum pivotally mounted in said frame and forming with said first and second winding drums a three drum cradle, a knife drum rotatably mounted in said frame adjacent said first winding drum and equipped with knife means for engaging said slot for severing said web along a transverse line, means operably associated with said first winding drum for immobilizing a free portion of said web against the surface of said first winding drum, said immobilizing being located a spaced distance from said slot rearward in the direction of rotation of said first winding drum to cause a severed web to fold rearwardly, said nip between said first and second drums being less than twice the web thickness so as to preclude passage of said web when the same is wound into an incipient log, and finger means mounted on said frame for limiting incipient log movement away from said nip upon increase in incipient log contact angle arising from increase in incipient log diameter.

20. The apparatus of claim 19 in which each of said first and second winding drums and said finger means are equipped with friction surfaces.

21. The apparatus of claim 19 in which said slot is equipped with resilient means to prevent entry of an incipient log thereinto.

22. The apparatus of claim 19 in which said nip has an upstream side and a downstream side, said upstream side being the side on which said web approaches said nip, said rider drum being on the downstream side of said nip, said apparatus being equipped with means for moving said second winding drum relative to said first winding drum.

23. The apparatus of claim 19 in which said nip has an upstream side and a downstream side, said upstream side being the side on which said web approaches said nip, said rider drum being on the upstream side of said nip, said apparatus being equipped with means mounting said second winding drum in fixed position relative to said first winding drum whereby said nip remains of constant size throughout the winding of a log.

24. In a method for convolute winding an elongated web log comprising the steps of providing a frame, a first winding drum rotatably mounted in said frame and equipped with a slot, means for advancing a web for travel with said first winding drum, a second winding drum rotatably mounted in said frame adjacent said first winding drum and spaced therefrom to form a nip, a rider drum pivotally mounted in said frame and forming with said first and second winding drums a three drum cradle, a knife drum rotatably mounted in said frame adjacent said first winding drum and equipped with knife means for engaging said slot for severing said web along a transverse line and means operably associated with said first winding drum for immobilizing a free portion of said web against the surface of said first winding drum, said immobilizing means being located a spaced distance from said slot rearward in the direction of rotation of said first winding drum to cause a severed web to fold rearwardly, and initially adjusting said nip to be less than twice the web thickness whereby said rearwardly folded severed web can be wound into an incipient log.

25. The method of claim 24 in which said steps include providing finger means and applying said finger means to said incipient log for limiting incipient log movement away from said nip.

26. The method of claim 25 in which said steps include moving said second winding drum away from first winding drum to enlarge the nip therebetween, passing said incipient log through said nip, and thereafter applying said rider drum to said incipient log.

27. The method of claim 26 in which said steps include maintaining said incipient log on one side of said nip and applying said rider drum to said incipient log while said finger means are still limiting incipient log movement away from said nip.

28. The method of claim 24 in which said steps include moving said second winding drum away from first winding drum to enlarge the nip therebetween, passing said incipient log through said nip, and thereafter applying said rider drum to said passed incipient log.

29. The method of claim 24 in which said steps include maintaining said incipient log on one side of said nip, applying said rider drum to said incipient log and applying finger means to limit incipient log movement away from said nip.

30. The method of claim 24 in which said steps include providing means for varying the speed of one of said drums and imparting a speed profile to said one drum to substantially eliminate slippage between said one drum and a web log being wound.

31. The method of claim 30 in which said steps include varying said speed profile to provide a tapered tension wind wherein an annular portion of said log is of a tension different from an annular portion adjacent thereto.

32. The method of claim 30 in which said steps include moving said one drum in an orbit once each winding cycle.

33. In a method of winding a web such as toilet tissue or toweling into a convolutely wound web without providing an axially extending opening, the steps of providing a three drum surface winding cradle including first and second winding drums and a rider drum, a knife roll associated with said one of said winding drums, said winding drums being spaced apart to provide a nip and the nip at the beginning of a wind being greater than the thickness of the web being wound but less than twice said web thickness, introducing a web into said nip for travel with said first winding drum, transversely severing said web and substantially simultaneously therewith immobilizing on said first drum a free portion of said web rearward in the direction of drum rotation of said transverse severing to develop a reverse fold in said web, subjecting said web reverse fold to rubbing action between said winding drums in said nip to cause said web fold to roll on itself to form an incipient log, and thereafter positioning said incipient log in said three drum winding cradle.

34. The method of claim 33 in which said steps include moving said second winding drum in an orbit to change the spacing of said nip.

35. The method of claim 33 in which said steps include imparting a speed profile to said second winding drum to minimize slippage between said second winding drum and an incipient log.

* * * * *